US008126584B2

(12) United States Patent
Yamada

(10) Patent No.: US 8,126,584 B2
(45) Date of Patent: Feb. 28, 2012

(54) EMBROIDERY DATA CREATION APPARATUS AND STORAGE MEDIUM STORING EMBROIDERY DATA CREATION PROGRAM

(75) Inventor: Kenji Yamada, Nagoya (JP)

(73) Assignee: Brother Kyogo Kabushiki Kaisha, Nagoya (JP)

( * ) Notice: Subject to any disclaimer, the term of this patent is extended or adjusted under 35 U.S.C. 154(b) by 392 days.

(21) Appl. No.: 12/453,829

(22) Filed: May 22, 2009

(65) Prior Publication Data

US 2009/0299518 A1 Dec. 3, 2009

(30) Foreign Application Priority Data

May 28, 2008 (JP) ..... 2008-139415

(51) Int. Cl.
*D05C 5/02* (2006.01)

(52) U.S. Cl. ..... 700/138

(58) Field of Classification Search ..... 700/136–138; 112/470.01, 475.18, 475.19
See application file for complete search history.

(56) References Cited

U.S. PATENT DOCUMENTS 5,839,380 A * 11/1998 Muto ..... 700/138
6,629,015 B2 * 9/2003 Yamada ..... 700/138
6,952,626 B1 10/2005 Taguchi et al.
7,089,079 B2 * 8/2006 Kaiya et al. ..... 700/136
2002/0038162 A1 * 3/2002 Yamada ..... 700/138
2005/0222704 A1 * 10/2005 Taguchi et al. ..... 700/138
2006/0027151 A1 * 2/2006 Kaiya et al. ..... 112/153
2008/0022910 A1 * 1/2008 Schweizer ..... 112/475.17

FOREIGN PATENT DOCUMENTS

JP A-5-212174 8/1993
JP A-10-131030 5/1998
JP A-11-114260 4/1999
JP A-2000-119948 4/2000
JP A-2005-278985 10/2005

* cited by examiner

*Primary Examiner* — Nathan Durham
(74) *Attorney, Agent, or Firm* — Oliff & Berridge, PLC

(57) ABSTRACT

An embroidery data creation apparatus for creating embroidery data required to sew embroidery that represents an image with a zigzag stitch, including an image storage device that stores the image made up of pixels each having a color value, a division device that divides the image into divided regions, each of which is a predetermined region through which one zigzag stitch passes through, a calculation device that calculates a reference swing position which provides a reference for swinging the zigzag stitch passing through each of the divided regions and a maximum value of a swing width of the zigzag stitch for each of the divided regions, based on the color values of the pixels in each of the divided regions; and an embroidery data creation device that creates the embroidery data based on the reference swing position and the maximum value of the swing width which are calculated.

9 Claims, 16 Drawing Sheets

900

901

EMBROIDERY DATA CREATION APPARATUS AND STORAGE MEDIUM STORING EMBROIDERY DATA CREATION PROGRAM

CROSS-REFERENCE TO RELATED APPLICATION

This application claims priority from JP 2008 139415, filed May 28, 2008, the content of which is hereby incorporated herein by reference in its entirety.

BACKGROUND

The present disclosure relates to an embroidery data creation apparatus and a storage medium storing an embroidery data creation program. More specifically, it relates to an embroidery data creation apparatus that creates embroidery data required to represent an image with embroidery and a storage medium storing an embroidery data creation program.

Conventionally, an image such as a photo or an illustration has been represented with embroidery by using a variety of sewing methods. One of these sewing methods is embroidering for representing an image with a pattern made up of a plurality of scanning lines disposed parallel to each other with predetermined spacing therebetween as shown in FIG. 15. Hereinafter, this method of representing by use of embroidery is referred to as a "blind stitch". FIG. 14 shows an original image 900 and FIG. 15 is a schematic diagram of an embroidery result 901 obtained from the original image 900 by sewing with blind stitches. In an example shown in FIG. 15, the original image 900 shown in FIG. 14 is divided into horizontally-long regions by dividing with a predetermined width vertically. A straight stitch is performed along a horizontal centerline (reference line) of each of the divided regions, while a zigzag stitch is performed on the portion corresponding to deep color portions in the original image 900. A swing width for the zigzag switch varies with how deep the color of the image is. Conventionally, embroidery cloth having this blind stitch performed on it has been proposed (see, for example, Japanese Patent Application Laid-Open No. 10-131030). Further, instead of a straight stitch, only a zigzag stitch is to be performed in accordance with an embroidery structure of an invention described in Japanese Patent Application Laid-Open No. 2000-119948. With changing swing width and angle of the zigzag stitch, a stitching density varies, thereby representing an image with embroidery.

SUMMARY

However, in the embroidery result 901 shown in FIG. 15, in an embroidery result of the invention described in Japanese Patent Application Laid-Open No. 10-131030, and that of the invention described in Japanese Patent Application Laid-Open No. 2000-119948, the reference lines are each one straight line that longitudinally runs parallel to each other along the centerline of each of the divided regions. Therefore, they have a problem that the embroidery result may give a blurred impression image generally in it.

A description will be given of reasons for this problem with reference to FIG. 16. FIG. 16 is a schematic diagram of a partially expanded portion of the image, showing seams 919, 929, and 939. In this example, for ease of explanation, a black-and-white two-value image is used as an example. Squares in FIG. 16 indicate pixels of the image. It is assumed that each square filled by hatching indicates a black pixel and that not filled by hatching indicates a white pixel. In FIG. 16, there are four clusters 941 to 944 of the black pixels. The image shown in FIG. 16 is divided into regions, which are separated from each other bounded by a dash-dotted line. These divided regions are assigned region numbers 910, 920, and 930 in this order from the top in FIG. 16. The divided region 910 has a reference line 911, the divided region 920 has a reference line 921, and the divided region 930 has a reference line 931. For example, the cluster 941 has the reference line 911 running along its cluster centerline. Therefore, a zigzag stitch is performed over the pixels, thus there is no disagreement between the image and an embroidery result. Also, in the cluster 942, the reference line 911 does not run along its cluster centerline but has a small disagreement of 0.5 pixels between the centerline thereof and the reference line 911. Therefore, the zigzag stitch is performed over the black pixels, thus there is a small disagreement between the image and a result of embroidery. On the other hand, the cluster 943 extends over both of the divided regions 920 and 930 and so has its centerline separated from the reference lines 921 and 931. The centerline of the cluster 943 is separated from the reference line 921 by three pixels' worth of a distance and from the reference line 931 by one pixel's worth of a distance. Therefore, the zigzag stitch that represented the cluster 943 is subdivided into two zigzag stitches of seams 929 and 939 respectively. Furthermore, since the cluster 944 has its centerline separated from the reference line 931 by 1.5 pixels' worth of a distance, the centerline of the cluster 944 may not agree with the zigzag stitch of the seam 930. Thus, by the conventional sewing method, there occurs such a portion that the black pixels may not agree with the seam, thus giving birth to an embroidery result having a blurred impression generally.

To solve these problems, the present disclosure has been developed, and it is an object of the present disclosure to provide an embroidery data creation apparatus that represents an image in such a manner that its embroidery by use of blind stitches may be closer to the original image and a storage medium storing an embroidery data creation program.

To solve the problems, in a first aspect of this disclosure, an embroidery data creation apparatus for creating embroidery data required to sew embroidery which represents an image with a zigzag stitch including an image storage device that stores the image made up of pixels each having a color value about the colors, a division device that divides the image stored in the image storage device into divided regions, each of which is a predetermined region which one zigzag stitch passes through, a calculation device that calculates a reference swing position which provides a reference for swinging the zigzag stitch passing through the divided region and a maximum value of a swing width of the zigzag stitch for each of the divided regions obtained as a result of division by the division device, based on the color values of the pixels in each of the divided regions, and an embroidery data creation device that creates the embroidery data based on the reference swing position and the maximum value of the swing width which are calculated by the calculation device.

To solve the problems, in a second aspect of this disclosure, an embroidery data creation apparatus for creating embroidery data required to sew embroidery which represents an image with a zigzag stitch including an image storage device that stores the image made up of pixels each having a color value about the colors, and a controller that divides the image stored in the image storage device into divided regions, each of which is a predetermined region which one zigzag stitch passes through, calculates a reference swing position which provides a reference for swinging the zigzag stitch passing through the divided region and a maximum value of a swing width of the zigzag stitch for each of the divided regions based on the color values of the pixels in each of the divided region, and creates the embroidery data based on the reference swing position and the maximum value of the swing width which are calculated.

To solve the problems, in a third aspect of this disclosure, a computer-readable storage medium storing an embroidery data creation program executable on a computer to function as an embroidery data creation apparatus for creating embroidery data required to sew embroidery which represents an image with a zigzag stitch, the program including an image storage step of storing the image made up of pixels each having a color value about the colors, a division step of dividing the image stored at the image storage step into divided regions, each of which is a predetermined region which one zigzag stitch passes through, a calculation step of calculating a reference swing position which provides a reference for swinging the zigzag stitch passing through the divided region and a maximum value of a swing width of the zigzag stitch for each of the divided regions divided at the division step, based on the color values of the pixels in each of the divided region; and an embroidery data creation step of creating the embroidery data based on the reference swing position and the maximum value of the swing width which are calculated at the calculation step.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Figure 1:
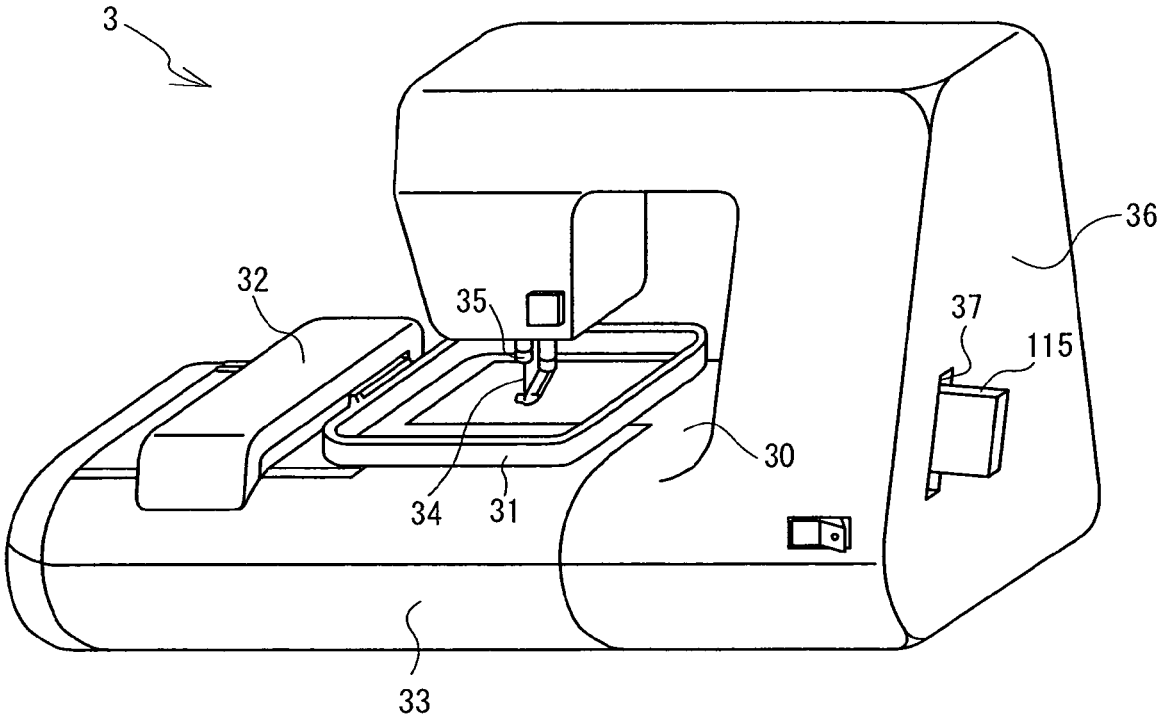
FIG. 1 is an outline view of an embroidery sewing machine.

A description will be given of one embodiment of an embroidery data creation apparatus 1 according to the present disclosure with reference to the drawings. Based on image data, the embroidery data creation apparatus 1 of the present embodiment creates embroidery data required to sew an image such as a photo or an illustration as an embroidery pattern by an embroidery sewing machine 3. First, a description will be given of the embroidery sewing machine 3.

The embroidery sewing machine 3 is arranged to sew a predetermined embroidery pattern onto work cloth through operations for sewing by a shuttle mechanism (not shown) and a needle bar 35 mounted with a sewing needle 34 while moving an embroidery frame 31 holding the work cloth to a predetermined position. The embroidery frame 31 is disposed on a sewing machine bed 30, holding work cloth to be embroidered. Further, the embroidery frame 31 is moved with an apparatus-specific XY coordinate system by using a Y-directional drive portion 32 and an X-directional drive mechanism (not shown) which is housed in a body case 33. The Y-directional drive portion 32, the X-directional drive mechanism, the needle bar 35 etc. are controlled by a control apparatus (not shown) configured of a microcomputer etc. built in the embroidery sewing machine 3. The embroidery sewing machine 3 has a memory card slot 37 formed in the side face of a pillar 36. If a memory card 115 storing embroidery data created by the embroidery data creation apparatus 1 is mounted into the memory card slot 37, the embroidery data will be loaded into the embroidery sewing machine 3.

Figure 2:
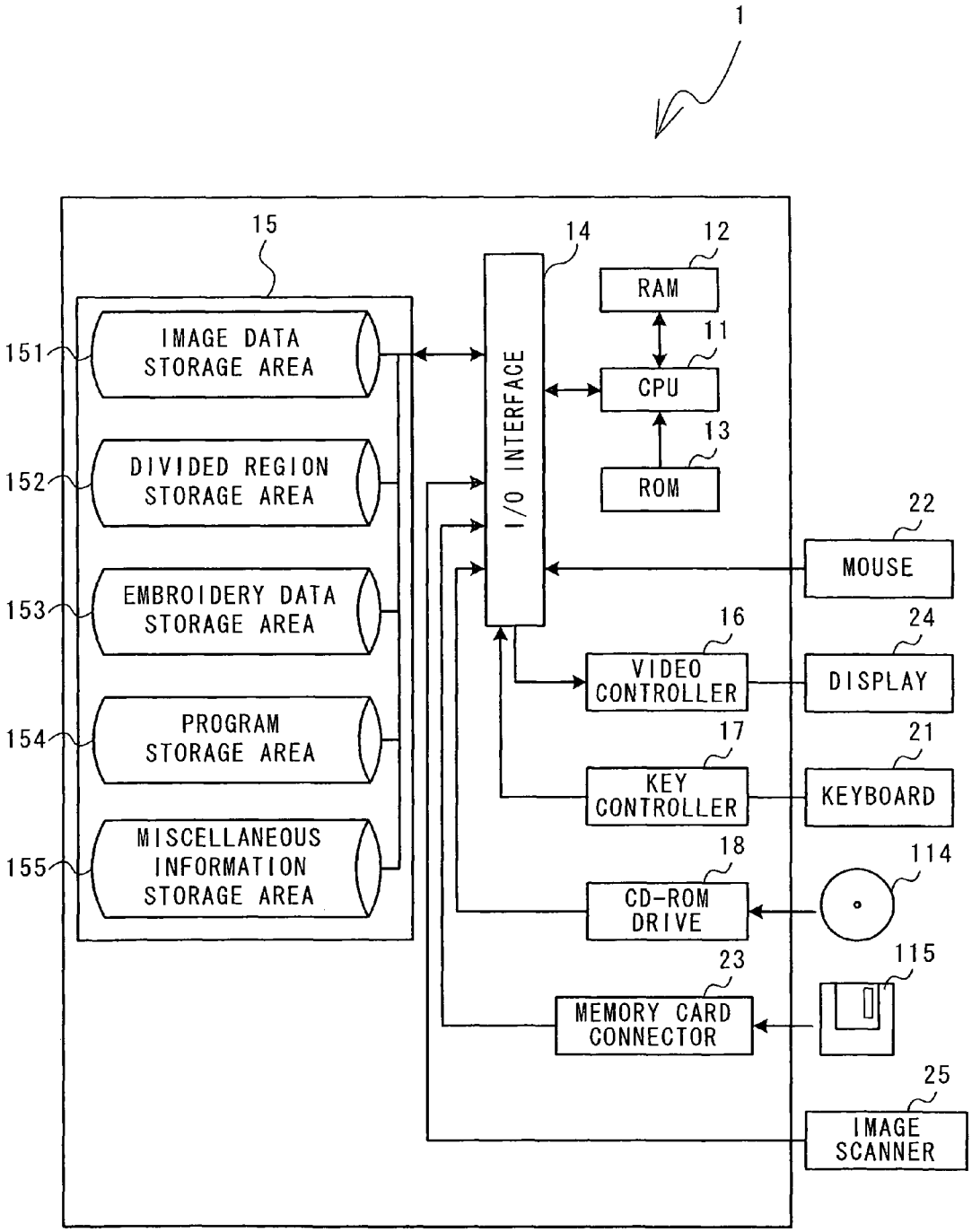
FIG. 2 is a block diagram showing an electrical configuration of an embroidery data creation apparatus.

Next, a description will be given of an electrical configuration of the embroidery data creation apparatus 1 with reference to a block diagram of FIG. 2. The embroidery data creation apparatus 1 is a so-called personal computer and connected to a keyboard 21, a mouse 22, a display 24, and an image scanner 25. As shown in FIG. 2, the embroidery data creation apparatus 1 is equipped with a CPU 11 that serves as a controller to control over the embroidery data creation apparatus 1. To the CPU 11 are connected an RAM 12 which stores various kinds of data temporarily, an ROM 13 in which a BIOS etc. are stored, and an I/O interface 14 which mediates transfer of data. To the I/O interface 14, a hard disk drive 15 is connected. The hard disk drive 15 has at least an image data storage area 151, a divided region storage area 152, an embroidery data storage area 153, a program storage area 154, and a miscellaneous information storage area 155.

The image data storage area 151 stores image data read by the image scanner 25. The image data stored in the image data storage area 151 may be the image data of an image picked up by a digital camera or that of an image created by drawing software. Further, the image data need not necessarily be acquired from the image scanner 25 but may be acquired from the memory of any other personal computer if the embroidery data creation apparatus 1 has a configuration to be able to be connected to a network. Additionally, the image data may be one stored in a CD-ROM 114 or the memory card 115. Further additionally, if the embroidery data creation apparatus 1 has a configuration being capable of reading data stored in any other recording medium, the image data may be acquired from this recording medium. It should be noted that in description of the present embodiment, for ease of explanation, image data will be used which is obtained by binarizing a value (hereinafter referred to as a "pixel color value") that indicates the color of each of the pixels of an image in creation of embroidery data. It is assumed that the pixel color value indicates black if it is "1" and white if it is "0".

The divided region storage area 152 stores information capable of identifying pixels, which make up each of divided regions in a condition where an image formed by image data to create embroidery data is divided into the divided regions (to be described in detail later). The embroidery data storage area 153 stores embroidery data created by an embroidery data creation program executed by the CPU 11. The embroidery data will be used when sewing embroidery in the embroidery sewing machine 3 and contains information such as seam positions and pitches. The program storage area 154 stores the embroidery data creation program. The miscellaneous information storage area 155 stores the other information that is used in the embroidery data creation apparatus 1. It should be noted that if the embroidery data creation apparatus 1 is not equipped with the hard disk drive 15 and so is used as a dedicated machine, the program would be stored in the ROM.

To the I/O interface 14 are connected the mouse 22, a video controller 16, a key controller 17, a CD-ROM drive 18, a memory card connector 23, and the image scanner 25. To the video controller 16 the display 24 is connected, and to the key controller 17 the keyboard 21 is connected. It should be noted that in the CD-ROM 114 to be inserted to the CD-ROM drive 18, the embroidery data creation program is stored which is a control program for the embroidery data creation apparatus 1. If the embroidery data creation apparatus 1 is introduced, the control program will be set up from the CD-ROM 114 to the hard disk drive 15 and stored in the program storage area 154. The reading and writing operations to the memory card 115 is executed via the memory card connector 23.

Figure 3:
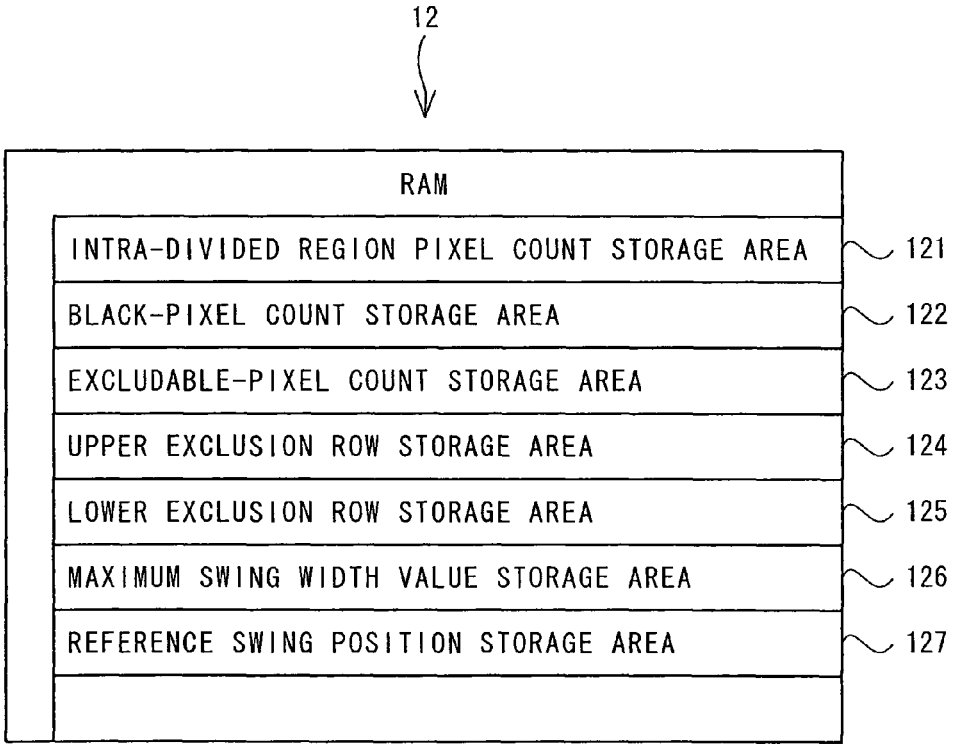
FIG. 3 is a schematic diagram showing a configuration of an RAM.

Next, a description will be given of storage areas arranged in the RAM 12 with reference to FIG. 3. As shown in FIG. 3, the RAM 12 includes an intra-divided region pixel count storage area 121, a black-pixel count storage area 122, an excludable-pixel count storage area 123, an upper exclusion row storage area 124, a lower exclusion row storage area 125, a maximum swing width value storage area 126, and a reference swing position storage area 127. It should be noted that the RAM 12 has other storage areas than those shown in the figure. The intra-divided region pixel count storage area 121, the black-pixel count storage area 122, the excludable-pixel count storage area 123, the upper exclusion row storage area 124, the lower exclusion row storage area 125, the maximum swing width value storage area 126, and the reference swing position storage area 127 will be used in embroidery data creation processing to be described below along a flowchart of FIG. 4.

Next, a description will be given of a procedure of the processing to create embroidery data from image data with reference to FIG. 4. Processing of the flowchart shown in FIG. 4 will be carried out when the embroidery data creation program is executed by the CPU 11 in the embroidery data creation apparatus 1.

Figure 4:
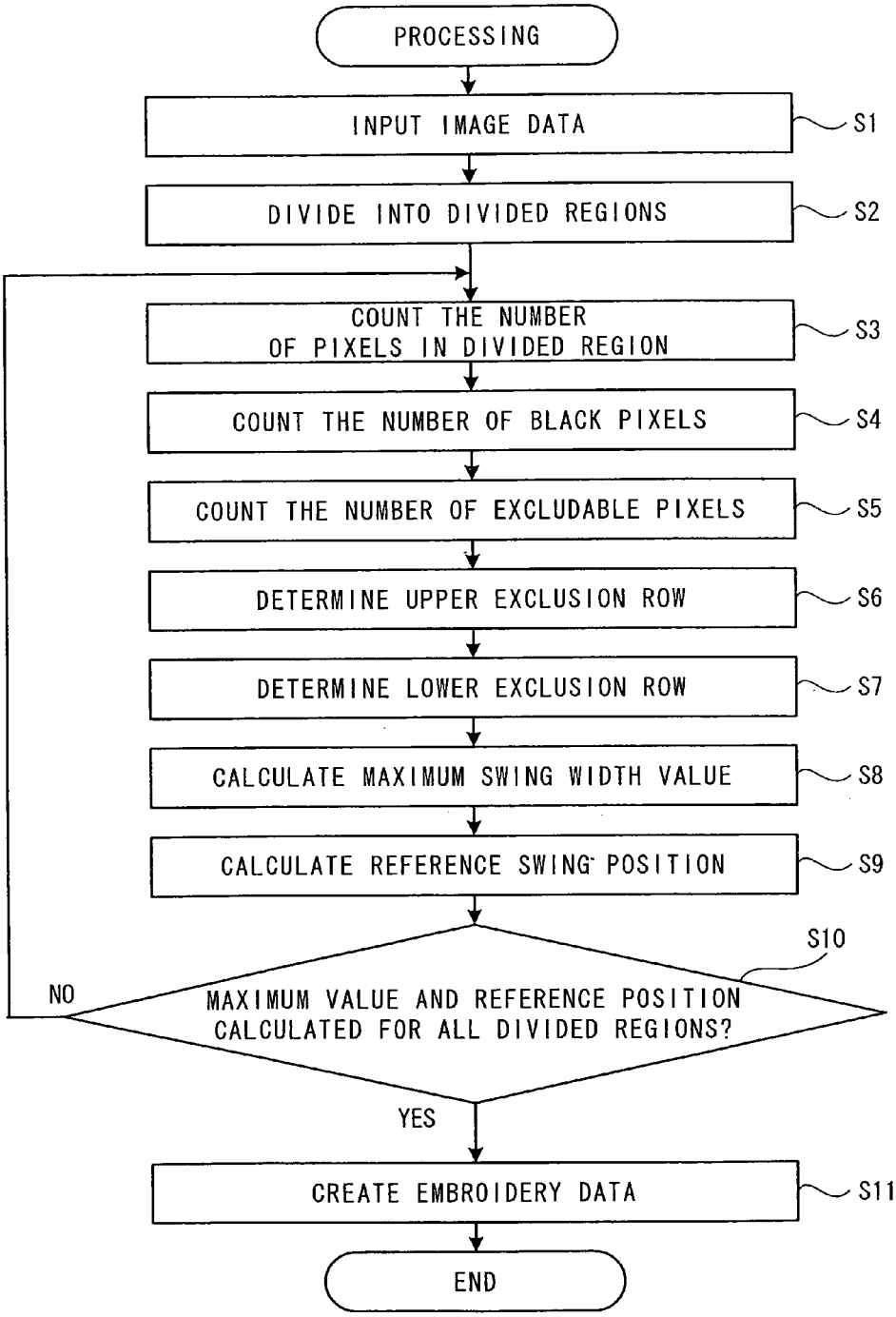
FIG. 4 is a flowchart showing a processing procedure.

As shown in FIG. 4, image data to create embroidery data is input from the image data storage area 151 (S1). Subsequently, an image to be represented by the acquired image data is divided into divided regions (S2).

Figure 5:
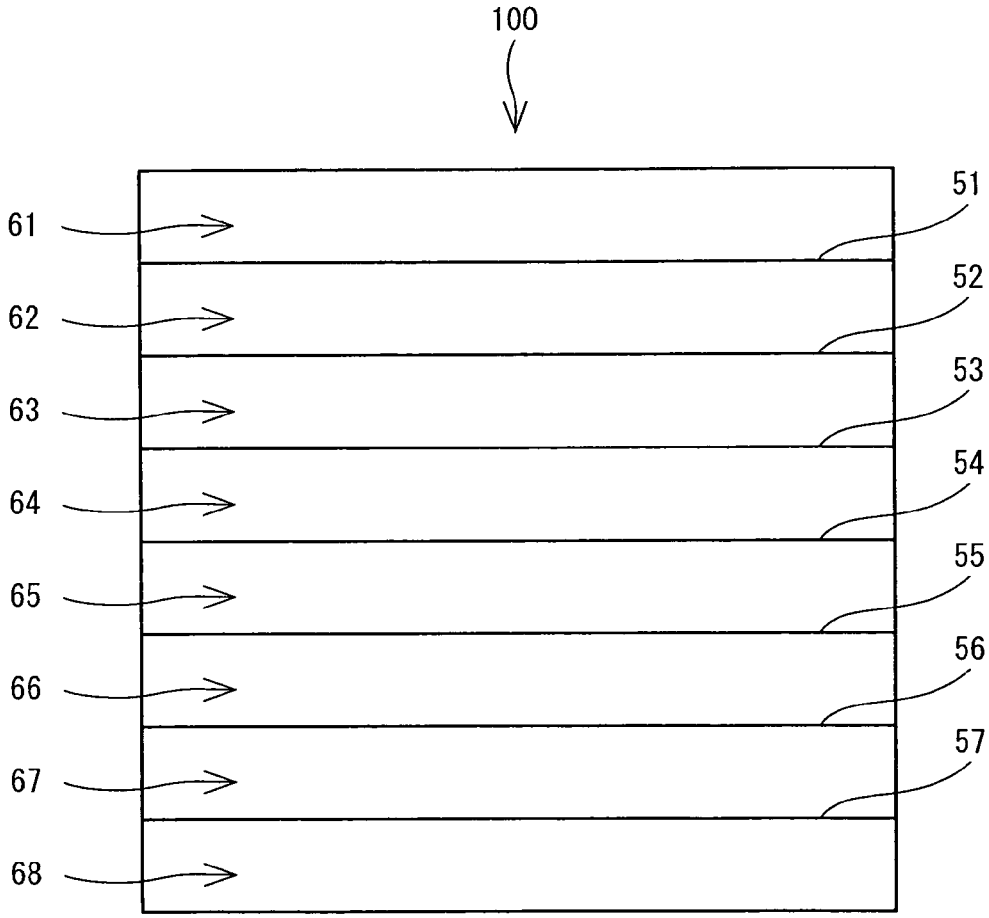
FIG. 5 is a schematic diagram showing a state where an entire region of an image is divided into large divided regions.
Figure 6:
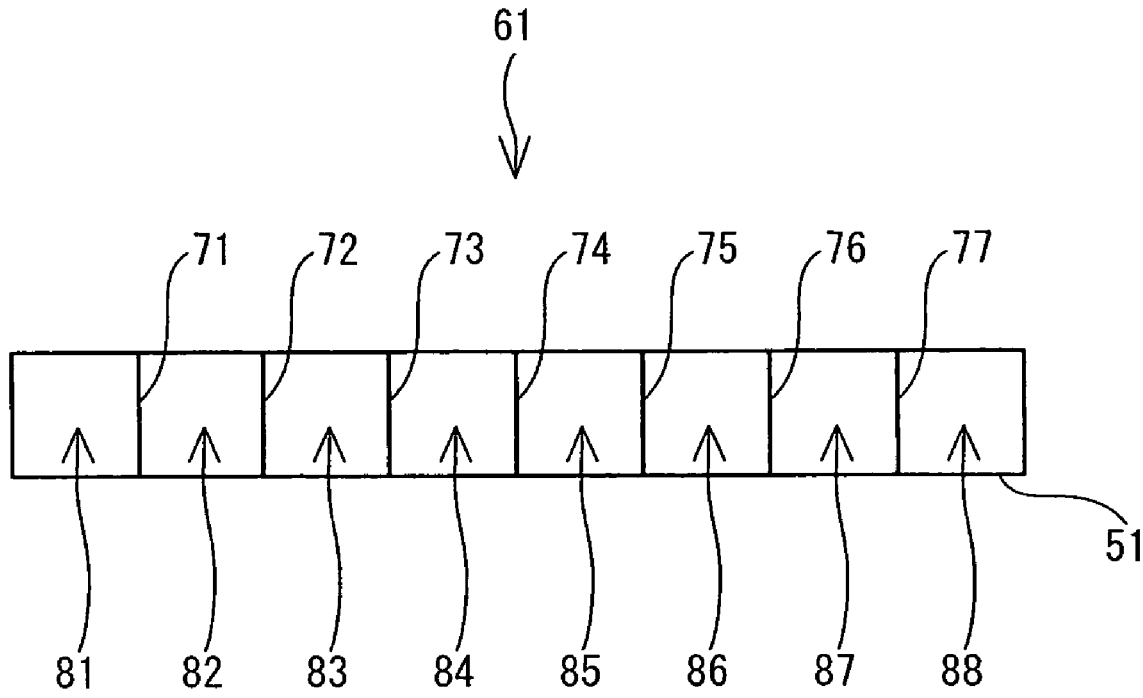
FIG. 6 is a schematic diagram showing a state where the large divided region is subdivided into divided regions.

Now, a description will be given of a method for determining divided regions with reference to FIGS. 5 and 6. First, an entire region 100 of the image is divided into large divided regions 61 to 68 by parting line segments 51 to 57 respectively. The entire region 100 is rectangular in shape. The parting line segments 51 to 57 are evenly spaced and parallel to each other as well as to the upper and lower sides of the entire region 100. In each of the large divided regions 61 to 68, one straight stitch or zigzag stitch is performed. For example, the straight or zigzag stitch is performed from the left end to the right end of the large divided region 61. Subsequently, a running stitch (straight stitch) is performed from the right end of the large divided region 61 to the right end of the large divided region 62, then a straight or zigzag stitch is performed from the right end to the left end of the large divided region 62. Then, a running stitch (straight stitch) is performed from the left end of the large divided region 62 to the left end of the large divided region 63, then a straight or zigzag stitch is performed from the left end to the right end of the large divided region 63. By thus causing the stitch to turn around at the end of each of the large divided regions 61 to 68, seams will cover all over the entire region 100. It should be noted that although the seven parting line segments have been given for ease of explanation, actually any appropriate number of line segments may be used. For example, the number of pixels sandwiched between parting line segments may be set up to dispose the parting line segments for each number of pixels thus determined in the entire region 100, thereby determining large divided regions.

After the large divided regions are determined, then the large divided regions 61 to 68 are each subdivided into divided regions. As shown in FIG. 6, the large divided region 61 is subdivided into divided regions 81 to 88 by finely parting line segments 71 to 77. It should be noted that in FIG. 6, the upper side of the large divided region 61 is that of the entire region 100 (see FIG. 5) and the lower side of the large divided region 61 is the parting line segment 51. The finely parting line segments 71 to 77 are perpendicular to the parting line segment 51. Therefore, the divided regions 81 to 88 are each rectangular in shape. It should be noted that although the seven finely parting line segments have been given for ease of explanation, actually any appropriate number of line segments may be used. For example, the number of pixels sandwiched between finely parting line segments may be set up to dispose the finely parting line segments for each number of pixels thus determined in the large divided region, thereby determining the divided regions.

Figure 7:
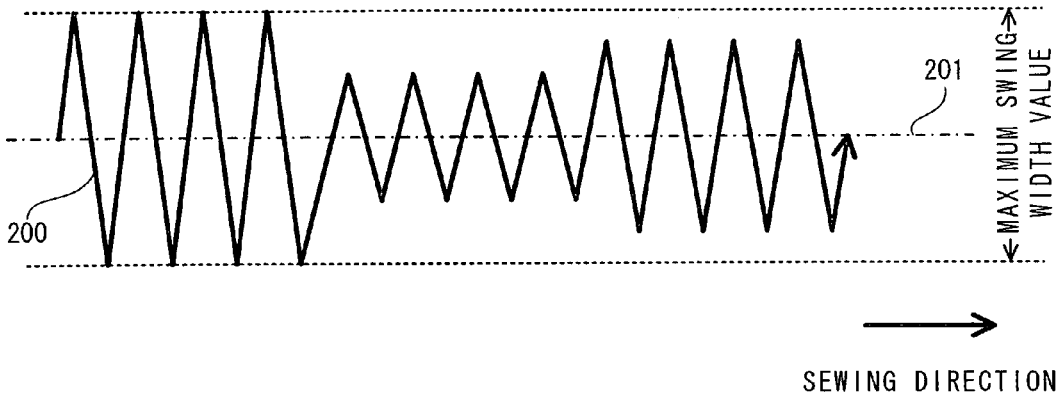
FIG. 7 is a schematic diagram showing a seam by zigzag stitches.
Figure 8:
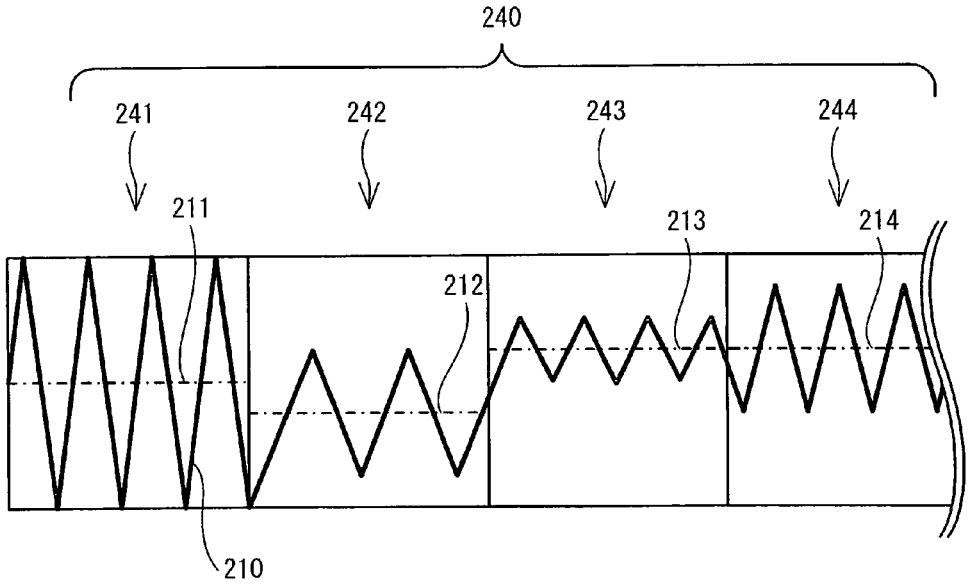
FIG. 8 is a schematic diagram showing another seam by zigzag stitches.

After the image is subdivided into divided regions (S2), a maximum swing width value and a reference swing position of a zigzag stitch are calculated for each of the divided regions (S3 to S10). Now, a description will be given of the maximum swing width value and the reference swing position of the zigzag stitch with reference to FIGS. 7 and 8. It is here assumed that seams 200 and 210 of FIGS. 7 and 8 may travel from the left to the right in the paper of the figures. As shown in FIG. 7, in zigzag stitching, a zigzag-shaped seam will be formed as the embroidery frame 31 holding work cloth moves reciprocally in such a direction as to intersect with a sewing direction. The vertex of the seam 200 corresponds to a needle drop point. In this case, the trajectory of the reference position of the sewing needle 34 (position of the sewing needle 34 in the case of a straight stitch) forms a reference line 201. In an example shown in FIG. 7, the same amount of swing is given on both of the upper and lower sides of the reference line 201. It should be noted that a total sum of the upper and lower swings is referred to as a "swing width". Information indicating the position of the reference line 201 provides a "reference swing position" and the swing width of a seam having the maximum swing along the reference line 201 provides a "maximum swing width value". The "reference swing position" and the "maximum swing width value" will be determined for each of the divided regions. The seam 210 shown in FIG. 8 is made up of zigzag stitches performed over the large divided region 240. The large divided region 240 is made up of the divided regions 241, 242, 243, 244, etc. In FIG. 8, the divided region 244 is not shown from its middle onward. As shown in FIG. 8, in some cases, positions of reference lines 211, 212, 213, and 214 may be different for each divided region even in the identical large divided region.

Figure 9:
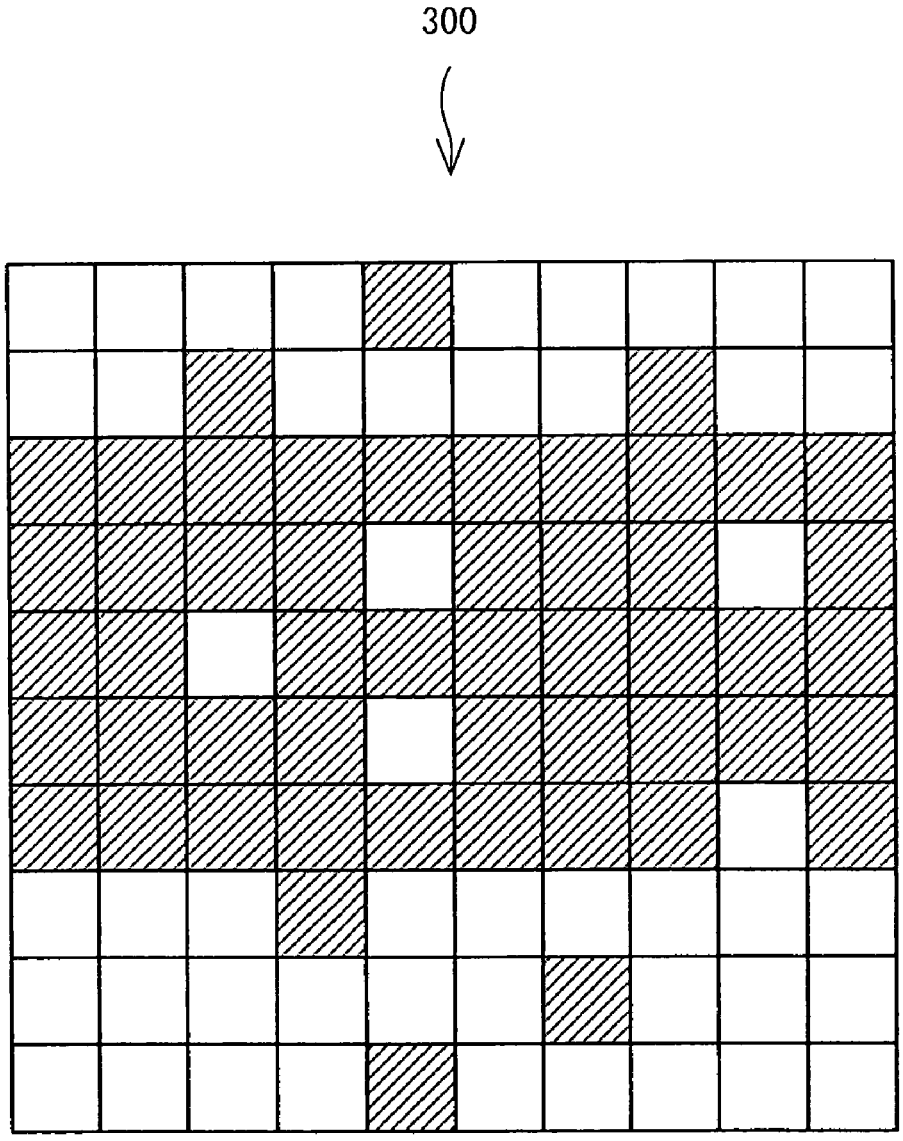
FIG. 9 is a schematic diagram of the divided regions.
Figure 10:
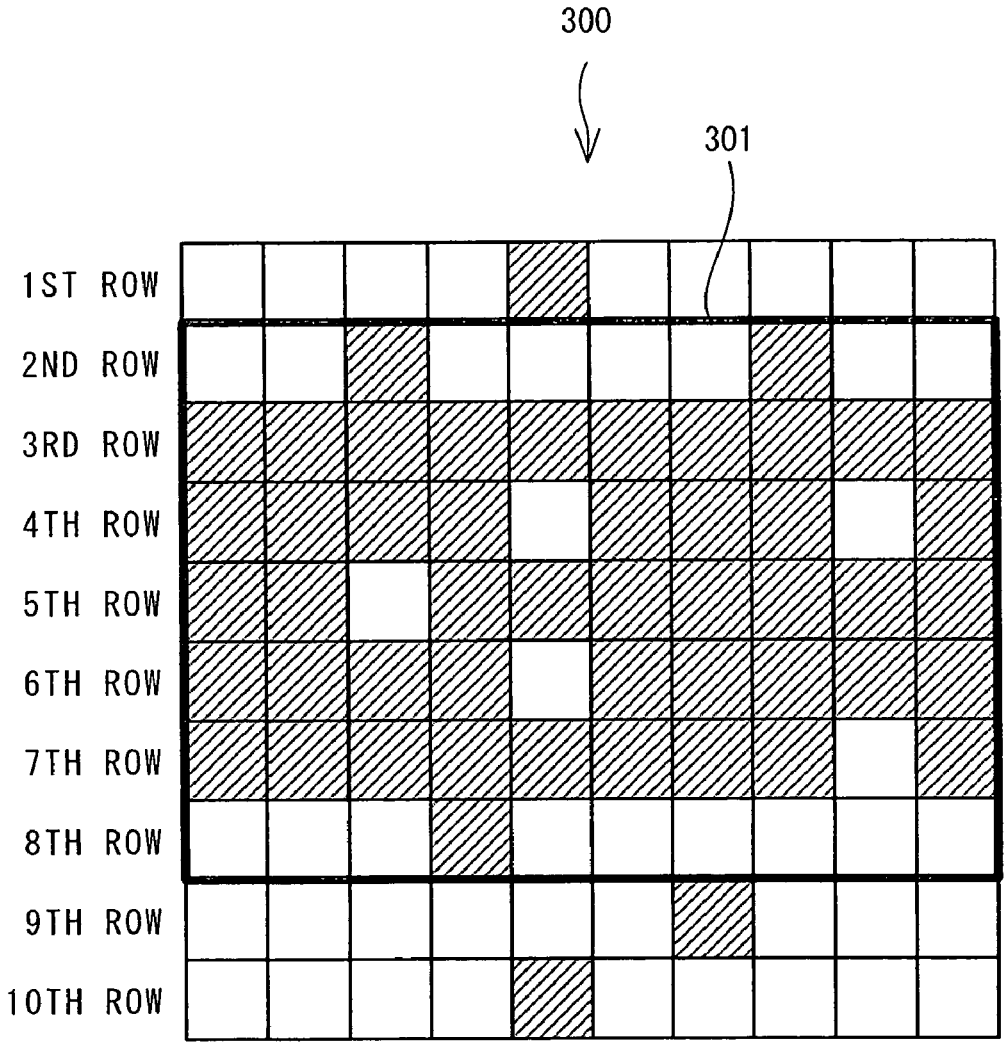
FIG. 10 is a schematic diagram showing such utility regions of the divided regions as to be utilized to calculate a maximum swing width value and a reference swing position.

Next, a description will be given of a method (S3 to S10) for calculating a maximum swing width value and a reference swing position with reference to FIGS. 9 and 10. In both of FIGS. 9 and 10, squares indicate a pixel, of which the squares filled by hatching indicate a black pixel and those not filled indicate a white pixel.

First, the number of pixels in a divided region 300 is counted and then stored in the intra-divided region pixel count storage area 121 (S3). The number of the pixels present in the divided region 300 shown in FIG. 9 is 100. Subsequently, the number of the black pixels in the divided region 300 is counted for each row and then stored in the black-pixel count storage area 122 together with a total number of the black pixels (S4). The total number of the black pixels present in the divided region 300 shown in FIG. 9 is 51. Subsequently, the number of excludable pixels is counted and then stored in the excludable-pixel count storage area 123 (S5). The number of the excludable pixels is a value obtained by multiplying the total number of the black pixels by an excludability ratio (truncating the fractional part). It should be noted that the excludability ratio is assumed to have been predetermined and stored in the miscellaneous information storage area 155 of the HDD 15. The excludability ratio may take on a different value for a different number of the pixels present in the divided region or be set by the user for each image. Here, the excludability ratio is assumed to be 5% (0.05). Therefore, in an example shown in FIG. 9, "the number of the excludable pixels=51'0.05=2.55≈2 (pixels)".

Subsequently, a utility region 301 in the divided region 300 is determined (S6, S7). The utility region 301 is a region including remaining rows after excluding the upper rows and the lower rows in the divided region based on the number of excludable pixels. First, the upper exclusion row is determined (S6). Here, a determination is made as to whether rows should be excluded sequentially on the rows downward from the first row. Specifically, if the total number of the black pixels counted from the first row up to the row subject to the determination on exclusion (hereinafter referred to as "determination row") is equal to or less than an excludable pixel count, the determination row is determined to be excluded. Then, the next row is determined. As a result, if this determination row is determined not to be excluded, the determination ends. As shown in FIG. 10, in the divided region 300, the first row has one black pixel, which is not more than two as the number of excludable pixels. Therefore, the first row is determined to be a "row to be excluded". Subsequently, the second row has two black pixels, so that the total number of black pixels on the first and second rows is three, which is more than two as the number of excludable pixels. Therefore, the second row is determined to be a "row not to be excluded". Since the second row is determined to be the "row not to be excluded", determination of the upper exclusion rows ends.

Next, lower exclusion rows are determined. Here, a determination is made as to whether rows should be excluded sequentially on the rows upward from the lowest row (tenth row). As shown in FIG. 10, in the divided region 300, the tenth row has one black pixel, which is not more than two as the number of excludable pixels. Therefore, the tenth row is determined to be a "row to be excluded". Subsequently, the ninth row has one black pixel, so that the total number of black pixels on the tenth and ninth rows is two. Thus, the total number of the black pixels present on the tenth and ninth rows is two, which is not more than two as the number of excludable pixels, so that the ninth row is determined to be a "row to be excluded". Subsequently, the eighth row has one black pixel, so that the total number of black pixels on the tenth, ninth, and eighth rows is three. This total number value is more than two as the number of excludable pixels, so that the eighth row is determined to be a "row not to be excluded". Since the eighth row is determined to be a "row not to be excluded", the determination of the lower exclusion rows ends now.

Subsequently, a maximum swing width value is determined and stored in the maximum swing width value storage area 126 in a condition where it is correlated with the divided region (S8). Specifically, the number of rows present in the utility region 301 is set as a maximum swing width value. In the example shown in FIG. 10, the first row is determined to be an upper exclusion row and the ninth and tenth rows are determined to be a lower exclusion row, so that the utility region 301 has seven rows (=10−1−2=7). Therefore, the maximum swing width value is 0.7 (=7/10=70%). Subsequently, a reference swing position is determined and stored in the reference swing position storage area 127 in a condition where it is correlated with the divided region (S9). Specifically, the vertical center position of the utility region 301 is set as a reference swing position. That is, this position is given by adding a ratio of the number of upper exclusion rows with respect to the total number of rows to a half of the maximum swing width value. In the example shown in FIG. 10, it is given by "7/10/2+1/10=0.35+0.1=0.45=45%". Therefore, in the example shown in FIG. 10, a reference line segment is disposed to a 45-percent position of the vertical length of the divided region 300 as measured from the top, so that a zigzag stitch is performed which has a maximum swing width value of 70/2=35% on both of the upper and lower sides thereof.

Subsequently, a determination is made on all the divided regions as to whether a maximum swing width value and a reference swing position are calculated (S10). If they are yet to be calculated on all the divided regions (NO at S10), a return is made to S3, where the processing is performed on the divided regions whose maximum swing width value and the reference swing position are yet to be calculated (S3 to S9). Then, the processing of S3 to S10 is repeated to calculate the maximum swing width value and the reference swing position on all the divided regions (YES at S10), whereupon embroidery data is created and stored in the embroidery data storage area 153 (S11).

In this case, the zigzag stitch embroidery data is created based on a maximum swing width value and a reference swing position which have been determined for each of the divided regions and pixel color values of the pixels in the utility region. The reference position for a zigzag stitch swing width is defined as a "reference swing position". Then, based on "the number of black pixels in the utility region/the total number of pixels in the utility region", an average of the pixel color values of the pixels in the utility region is calculated.

Figure 11:
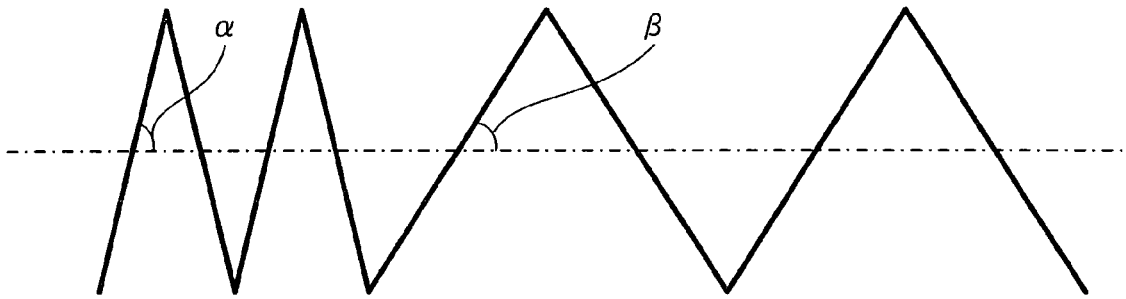
FIG. 11 is a schematic diagram showing an angle of the seam.

Then, a known method is used to calculate a swing width and seam angle for each seam with reference to the reference swing position used as a reference for zigzag stitching based on the average value of the pixel color values, the maximum swing width value, and a predetermined maximum value of a seam density. Next, a needle drop point is determined based on the seam angle and the swing with, to create embroidery data. It should be noted that the swing width in this case is assumed to be a value not in excess of the "maximum swing width value". In this case, the seam angle refers to the angle of a seam with respect to the reference line. Angles a and b shown in FIG. 11 indicate a seam angle. As shown in FIG. 11, angle a>angle b. In such a manner, if the average of pixel color value is large, the seam angles are increased in order to make the seam dense, while on the other hand, if the average of pixel color value is small, the seam angles are decreased in order to make the seam sparse. Further, the smaller the swing width is, the smaller the seam region becomes. By thus determining a seam angle and a swing width based on the number and the layout of the black pixels in the divided region, an original image may be more accurately represented in a result of embroidery. It should be noted that the density of a seam may be set to one numerical value beforehand or determined for each sewing machine to be used or set by the user at will.

Figure 12:
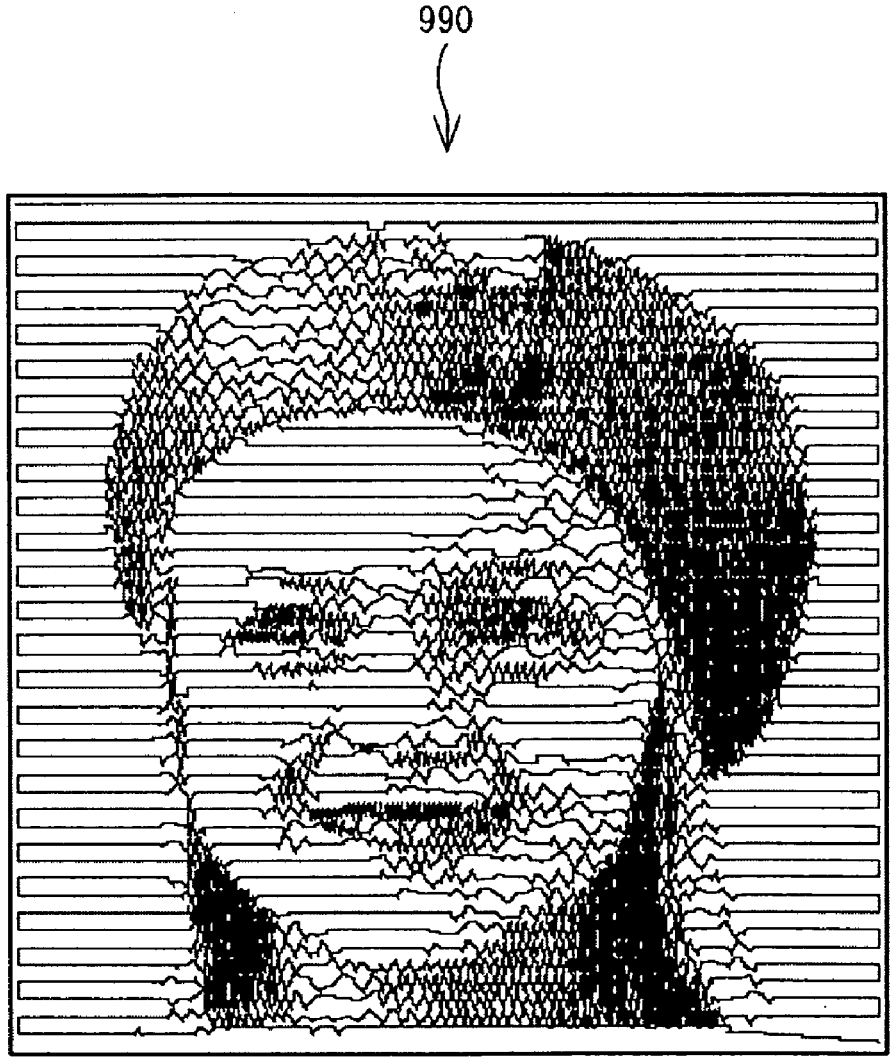
FIG. 12 is a schematic illustration of an embroidery result obtained by embroidering an original image shown in FIG. 14 by using embroidery data created by a method of the present embodiment.
Figure 14:
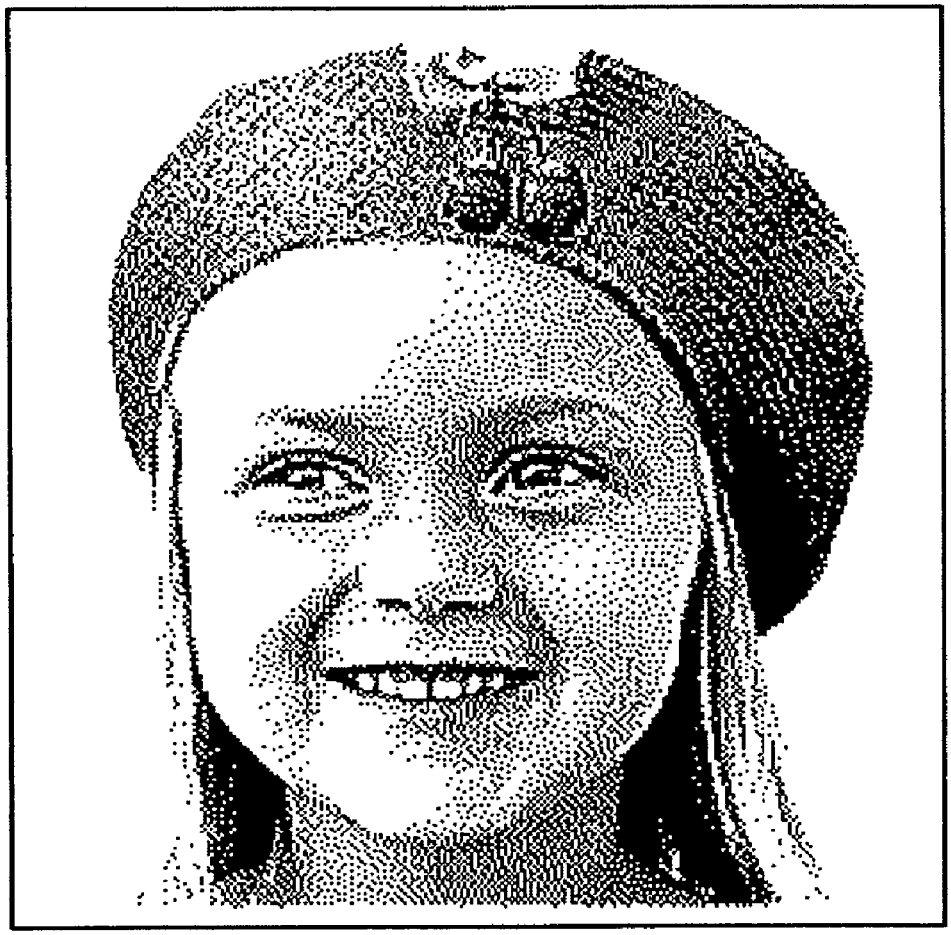
FIG. 14 RELATED ART
FIG. 14 is an illustration showing the image.
Figure 15:
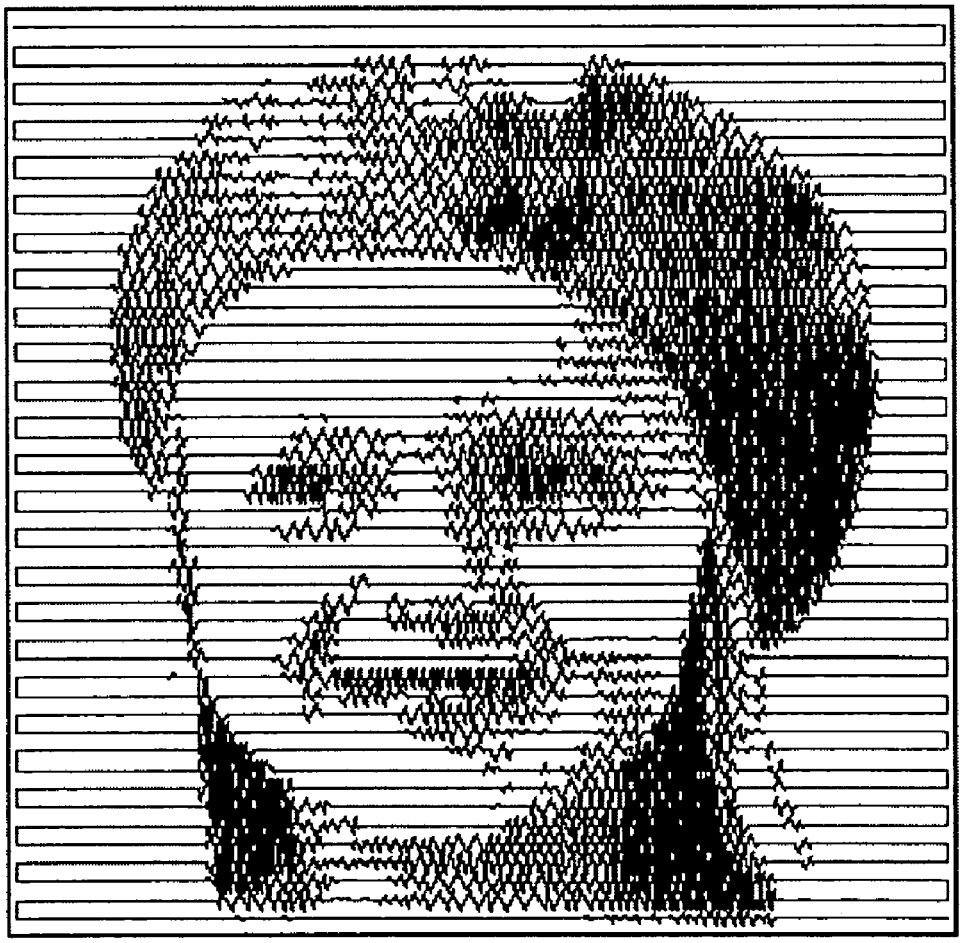
FIG. 15 RELATED ART
FIG. 15 is a schematic illustration of an embroidery result in a case where the image is sewed using blind stitches.
Figure 16:
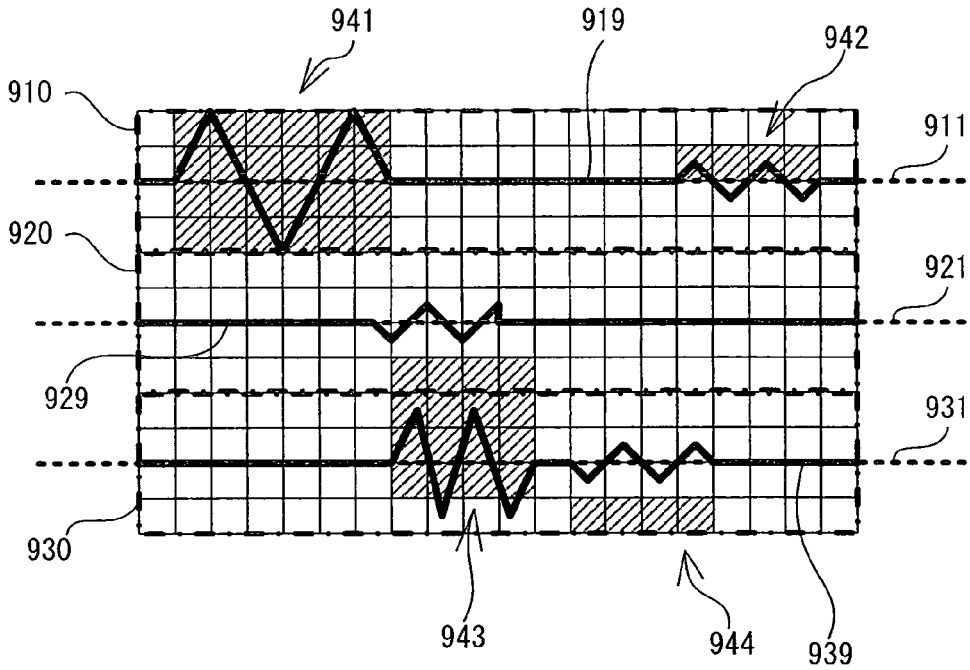
FIG. 16 RELATED ART
FIG. 16 is a schematic diagram showing the seams by expanding part of the image.

In such a manner, by the method of the present embodiment, an image is subdivided into divided regions (S2) and a utility region is determined for each of the divided regions to calculate a maximum swing width value and a reference swing position (S3 to S9). Then, embroidery data is created based on the maximum swing width value and the reference swing position for each of the divided region. Accordingly, the reference swing position for a zigzag stitch is determined for each divided region, so that seams will get closer to the position of the black pixels. Therefore, by the method of the present embodiment, an original image can be represented more finely by embroidery. An image 900 shown in FIG. 14 is represented in the embroidery result shown in FIG. 12 of embroidery based on the embroidery data created by the method of the present embodiment more finely than in an embroidery result 901 shown in FIG. 15. In FIG. 12, in particular, the lips and the eyes of a girl are represented more finely, so that her representation and eyes can be recognized in the original image.

Thus, in the embroidery data creation apparatus of the present disclosure, when creating embroidery data for sewing embroidery which represents an image by using a zigzag stitch, the image is subdivided into divided regions as a predetermined region which one zigzag stitch may pass through. Then, for the zigzag stitch passing through each of the divided regions, a reference swing position for a zigzag stitch swing reference and a maximum swing width value are calculated based on values about the color of pixels in this divided region. Therefore, the position which a seam of the zigzag stitch passes through in the divided region can be changed in accordance with the color of the pixels in this divided region, thereby creating embroidery data for sewing embroidery that represents the original image more finely.

Further, in the embroidery data creation apparatus of the present disclosure, first a division device divides an image into large divided regions with a plurality of parting line segments which do not intersect with each other. In this case, each parting line segment is considered to be a border line between the large divided regions. The division device further subdivides the large divided region with a plurality of finely parting line segments which intersect with the parting line segments, thus determining divided regions. That is, an original image is divided into large divided regions, each of which is further subdivided into divided regions. Then, one continuous zigzag stitch is performed over the large divided region. Further, a reference swing position and a maximum swing width value for the zigzag stitch are determined for each of the divided regions, so that the reference swing position and the maximum swing width value for the zigzag stitch that passes through the large divided region are not constant and change with the color of the pixels in the divided region. It is thus possible to create embroidery data for sewing embroidery that represents the original image more finely.

Further, in the embroidery data creation apparatus of the present disclosure, a calculation device determines such a utility region in the divided region as to be utilized in order to determine a maximum swing width value and a reference swing position, based on the color values of pixels in this divided region. It then determines the maximum swing width value based on the length of the finely parting line segment in the utility region and the reference position based on the length of the finely parting line segment in the utility region and the position of the utility region in the divided region. By thus determining a utility region based on the color of pixels in a divided region and determining a maximum swing width value and a reference swing position which are specific to this utility region, it is possible to create embroidery data for sewing embroidery that represents the original image more finely.

Further, in the embroidery data creation apparatus of the present disclosure, a reference value is calculated based on the color values of pixels in a divided region. Then, the comparison value based on the color values of the pixels in each of rows of the pixels in the divided region is compared to a reference value sequentially starting from the row along the parting line segment, thereby determining whether the pixels in this row should be utilized. In this case, until such a row is encountered as to be determined to be utilized, that is, if the row is determined not to be utilized, the pixels in this row are deleted. Then, a region of the pixels thus left undeleted is used as a utility region. Therefore, the reference value changes in accordance with the color values of pixels in the divided region, while the comparison value also changes with the color values of pixels in a row in the divided region. With this, a utility region can be more finely determined in accordance with the color values of the pixels and hence a maximum swing width value and a reference swing position can be determined, thereby creating embroidery data for sewing embroidery that represents the original image more finely.

Further, almost the same effects as those by the above-described embroidery data creation apparatus can be obtained by causing a computer to execute an embroidery data creation program stored in a computer-readable recording medium of the present disclosure.

It is understood that the embroidery data creation apparatus of the present disclosure is not limited to the above-described embodiment and of course can be modified variously without departing from the gist of the present disclosure. Although the above embodiment has used a personal computer as the embroidery data creation apparatus 1, the embroidery data creation program may be stored in a sewing machine so that embroidery data might be created in the sewing machine.

Further, although the above embodiment has used an image in which the color values of pixels are binarized, a grayscale image may be used which has multi-valued color tones as the pixel color value. In this case, the pixel color value should be reflected in the step of counting the number of the black pixels (S4), the step of calculating the number of excludable pixels (reference value) (S5), the step of determining the upper exclusion row (S6), and the step of determining the lower exclusion row (S7). In counting of the number of the black pixels (S4), for example, a threshold value is set in order to count the number of the pixels whose color value is not less than this threshold value. Further, for example, at S4, the color values of all the pixels are summed up. In this case, further, in calculation of the number of excludable pixels (S5), for example, a value obtained by multiplying a value calculated at S4 by an excludability ratio (excludable pixel's color value) may be set as a "reference value". Then, in determination of the upper exclusion row (S6) and determination of the lower exclusion row (S7), the color values of the pixels in a determination row should be summed up so as to determine whether to exclude this row based on whether the sum is equal to or more than the "excludable pixel's color value".

Figure 13:
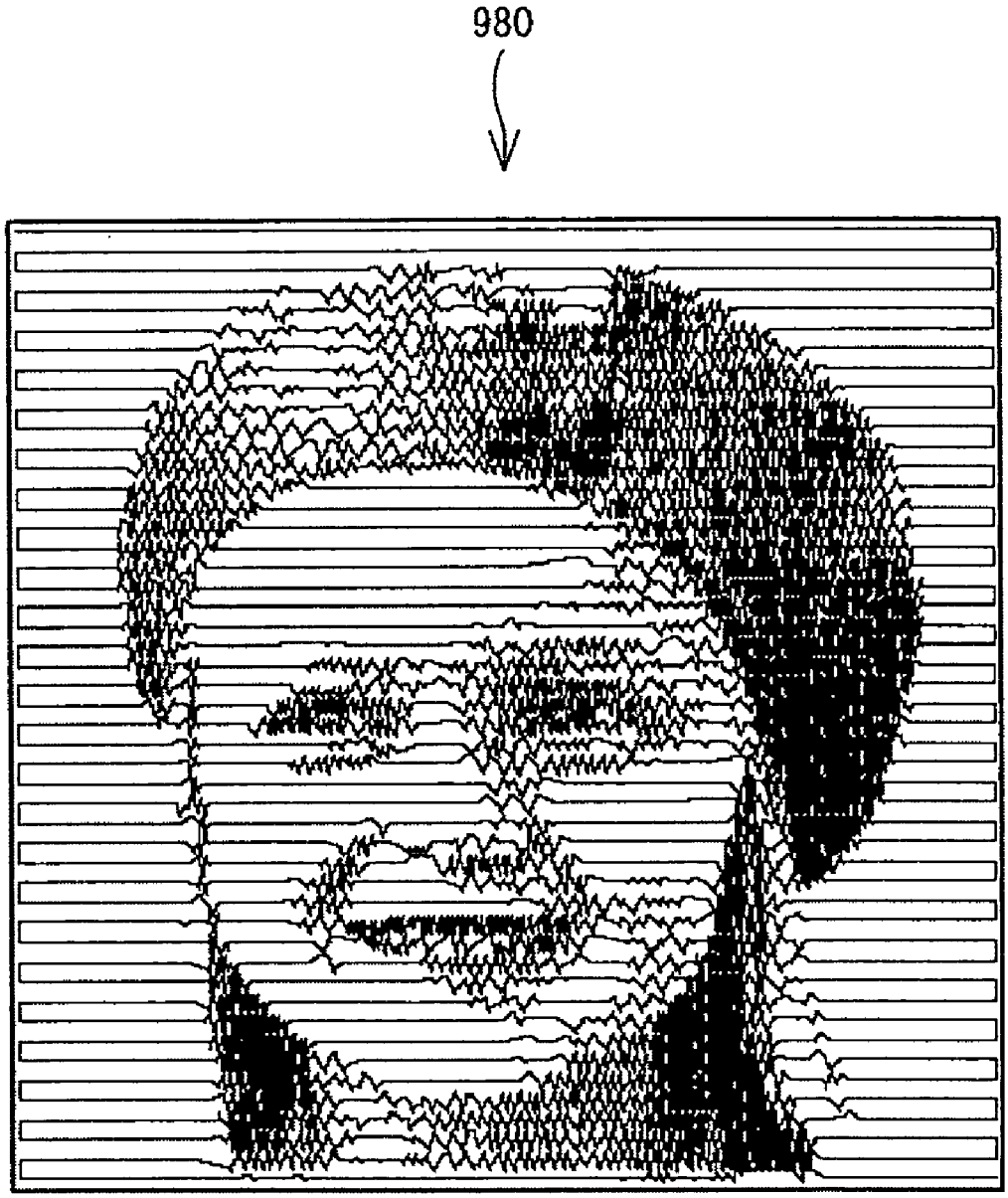
FIG. 13 is a schematic illustration of an embroidery result obtained by embroidering the original image shown in FIG. 14 by using embroidery data created by a method of a related art.

Further, in the above embodiment, a utility region has been determined for all of divided regions, to create embroidery data by using a maximum swing width value and a reference swing position that have been determined on the basis of the utility region. However, in an embroidery result 990 shown in FIG. 12, in contrast to finely represented portions of an original image, there may be portions such as the left temple and a portion below the left cheek that have a general impression of rough processing owing to the upward and downward movements of the reference line with respect to a 50-percent position. Such portions may look more beautiful due to fine processing by means of a method of the related art (whereby the reference position for zigzag stitching is fixed to the 50-percent level) shown in FIG. 15. In those portions, the seam angle is small and the seam density is low, that is, the density of the black pixels is low. Accordingly, when the embroidery data is created, the reference position for zigzag stitching may be set not to a position calculated using a utility region but to the 50-percent position in a portion where the seam angle is smaller than a threshold value. That is, a calculation method of the related art may be used as it is. FIG. 13 shows an embroidery result 980 of a case where the thus created embroidery data is used in embroidery. As shown in it, such an embroidery result can be obtained that the image may be represented finely around the left temple and the left cheek while representing the lips and the eyes in detail.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data creation apparatus for creating embroidery data required to sew embroidery that represents an image with a zigzag stitch, comprising:

an image storage device that stores the image made up of a plurality of pixels, each of the pixels having a color value;

a division device that divides the stored image device into divided regions, each of which is a predetermined region through which one zigzag stitch passes;

a calculation device that calculates a reference swing position that provides a reference for swinging the zigzag stitch passing through each of the divided regions and a maximum value of a swing width of the zigzag stitch for each of the divided regions, based on the color values of the pixels in each of the divided regions; and an embroidery data creation device that creates the embroidery data based on the calculated reference swing position and the calculated maximum value of the swing width, wherein:

the division device divides the image into a plurality of large divided regions with a plurality of parting line segments that do not intersect with each other;

the division device subdivides the large divided regions with a plurality of finely parting line segments that intersect with the parting line segments, thereby determining the divided regions; and the embroidery data creation device creates the embroidery data such that one continuous zigzag stitch is performed over each of the large divided regions.

2. The embroidery data creation apparatus according to claim 1, wherein the calculation device includes:

a utility region determination device that determines a utility region in the divided region that is utilized for calculating the reference swing position and the maximum value of the swing width, based on the color values of the pixels in the divided region;

a maximum value determination device that calculates the maximum value of the swing width based on a length of the finely parting line segment in the determined utility region; and a reference position determination device that calculates the reference swing position based on the length of the finely parting line segment in the utility region and a position of the utility region in the divided region.

3. The embroidery data creation apparatus according to claim 2, wherein the utility region determination device includes a reference value calculation device that:

calculates a reference value that is used for determining the pixels that are not utilized, based on the number of the pixels in the divided region and the color values of the pixels in the divided region;

compares a comparison value calculated on the basis of the color values of the pixels included in a row of the pixels along the parting line segment and the calculated reference value sequentially starting from the row in contact with the parting line segment;

determines whether the pixels of the row should be utilized as the utility region;

deletes the pixels of the row from the divided region until they are determined to be utilized; and determines the region of the undeleted pixels as the utility region.

4. An embroidery data creation apparatus for creating embroidery data required to sew embroidery that represents an image with a zigzag stitch, comprising:

an image storage device that stores the image made up of a plurality of pixels, each of the pixels having a color value; and a controller that:

divides the stored image into divided regions, each of which is a predetermined region through which one zigzag stitch passes;

calculates a reference swing position that provides a reference for swinging the zigzag stitch passing through each of the divided regions and a maximum value of a swing width of the zigzag stitch for each of the divided regions based on the color values of the pixels in each of the divided regions; and creates the embroidery data based on the calculated reference swing position and the calculated maximum value of the swing width, wherein the controller:

divides the image into a plurality of large divided regions with a plurality of parting line segments that do not intersect with each other;

subdivides the large divided regions with a plurality of finely parting line segments that intersect with the parting line segments, thereby determining the divided regions, and creates the embroidery data such that one continuous zigzag stitch is performed over each of the large divided regions.

5. The embroidery data creation apparatus according to claim 4, wherein the controller determines a utility region in the divided region that is utilized for calculating the reference swing position and the maximum value of the swing width, based on the color values of the pixels in the divided region, calculates the maximum value of the swing width based on a length of the finely parting line segment in the determined utility region, and calculates the reference swing position based on the length of the finely parting line segment in the determined utility region and a position of the utility region in the divided region.

6. The embroidery data creation apparatus according to claim 5, wherein the controller calculates a reference value that is used for determining the pixels that are not utilized, based on the number of the pixels in the divided region and the color values of the pixels in the divided region, compares a comparison value calculated on the basis of the color values of the pixels included in a row of the pixels along the parting line segment and the calculated reference value sequentially starting from the row in contact with the parting line segment, determines whether the pixels of the row should be utilized as the utility region, deletes the pixels of the row from the divided region until they are determined to be utilized, and determines the region of the undeleted pixels as the utility region.

7. A non-transitory computer-readable storage medium storing an embroidery data creation program executable on a computer to function as an embroidery data creation apparatus for creating embroidery data required to sew embroidery that represents an image with a zigzag stitch, the program comprising instructions for:

storing the image made up of a plurality of pixels, each of the pixels having a color value;

dividing the stored image into divided regions, each of which is a predetermined region which one zigzag stitch passes;

calculating a reference swing position that provides a reference for swinging the zigzag stitch passing through each of the divided regions and a maximum value of a swing width of the zigzag stitch for each of the divided regions divided, based on the color values of the pixels in each of the divided regions; and creating the embroidery data based on the calculated reference swing position and the calculated maximum value of the swing width, wherein in dividing the image, the image is divided into a plurality of large divided regions with a plurality of parting line segments that do not intersect with each other, and the large divided regions are subdivided with a plurality of finely parting line segments which intersect with the parting line segments, thereby determining the divided regions; and in creating embroidery data, the embroidery data is created such that one continuous zigzag stitch performing over each of the large divided regions is created.

8. The recording medium according to claim 7, wherein in calculating the reference swing position, a utility region in the divided region that is to be used for calculating the reference swing position and the maximum value of the swing width is determined based on the color values of the pixels in the divided region;

the maximum value of the swing width is calculated based on a length of the finely parting line segment in the determined utility region that is determined; and the reference swing position is calculated based on the length of the finely parting line segment in the utility region and a position of the utility region in the divided region.

9. The recording medium according to claim 8, wherein in determining the utility region, a reference value used for determining the pixels that are not utilized is calculated, based on the number of the pixels in the divided region and the color values of the pixels in the divided region;

a comparison value calculated on the basis of the color values of the pixels included in a row of the pixels along the parting line segment and the calculated reference value are compared sequentially starting from the row in contact with the parting line segment, the pixels of the row are determined as to whether the pixels of the row should be utilized or not, the pixels of the row are deleted from the divided region until they are determined to be utilized, and the region of the undeleted pixels is determined as the utility region.

* * * * *

UNITED STATES PATENT AND TRADEMARK OFFICE

CERTIFICATE OF CORRECTION

PATENT NO. : 8,126,584 B2
APPLICATION NO. : 12/453829
DATED : February 28, 2012
INVENTOR(S) : Kenji Yamada It is certified that error appears in the above-identified patent and that said Letters Patent is hereby corrected as shown below:

On the Title page please delete the following:

Item "(73) Brother Kyogo Kabushiki Kaisha, Nagoya (JP)"

And Replace with

Item (73) Brother Kogyo Kabushiki Kaisha, Nagoya (JP)

Signed and Sealed this
Tenth Day of July, 2012

David J. Kappos

David J. Kappos
*Director of the United States Patent and Trademark Office*